United States Patent [19]

Richards

[11] 4,432,547

[45] Feb. 21, 1984

[54] INFLATABLE BALL REPAIR

[75] Inventor: Malcolm E. Richards, Litchfield Park, Ariz.

[73] Assignee: Mafix, Incorporated, Litchfield Park, Ariz.

[21] Appl. No.: 404,361

[22] Filed: Aug. 2, 1982

[51] Int. Cl.[3] ..... A63B 41/12; A63B 41/08; B32B 35/00

[52] U.S. Cl. ..... 273/65 R; 156/98; 156/156; 156/250; 156/280; 156/423; 156/514; 264/36; 273/61 D; 273/65 D; 273/65 ED; 427/140; 428/63

[58] Field of Search ..... 156/94, 98, 156, 250, 156/280, 423, 513, 514; 273/65 A, 65 C, 61 D, 65 D, 65 ED, 65 R; 264/36; 427/140; 428/63

[56] References Cited

U.S. PATENT DOCUMENTS

| | | | |
|---|---|---|---|
| 1,436,630 | 11/1922 | Büchner et al. | 273/65 C |
| 2,012,376 | 8/1935 | Caro | 273/65 C |
| 2,387,455 | 10/1945 | McDermott | 273/65 D |
| 4,012,041 | 3/1977 | Hoffman | 273/61 D |
| 4,240,630 | 12/1980 | Hoffman | 273/61 R |
| 4,274,633 | 6/1981 | Benscher | 273/65 C |
| 4,320,776 | 3/1982 | Yang | 273/65 C X |
| 4,341,382 | 7/1982 | Arnold | 273/65 C |

FOREIGN PATENT DOCUMENTS 528832 11/1940 United Kingdom .

*Primary Examiner*—Robert A. Dawson
*Attorney, Agent, or Firm*—James F. Duffy

[57] ABSTRACT

Means and method for repairing an inflatable ball damaged to the extent that its ability to remain inflated has been impaired in which the method comprises the steps of removing a portion of the ball covering so as to permit the removal of the damaged bladder, if any, and the insertion of a new or replacement bladder; maintainably positioning the new or replacement bladder within the ball covering for ease of inflation thereof; and the restoring of the surface integrity of the ball cover while providing external access through the restored surface to the inflation valve of the new or replacement bladder. Apparatus has been disclosed for carrying forth the steps of the method and the end result of practicing the method is seen to be a manufacture comprising a repaired inflatable ball.

25 Claims, 7 Drawing Figures

INFLATABLE BALL REPAIR

BACKGROUND

1. Field of the Invention

The invention relates to method and apparatus for the repair of inflatable balls.

In particular, the invention relates to the method and apparatus whereby a damaged inflatable ball may be repaired by the incorporation of an inflatable bladder.

2. Prior Art

Air inflated balls are used in many sports, for example football, soccer, basketball, etc. In general, such inflatable balls are provided with a leather, or leather-like covering. This covering is comprised of a plurality of parts which are stitched at the time of manufacture to provide a playing ball of the desired shape when inflated with air. The ball may incorporate an internal bladder within the covering which fills with air to fill the inner contour of the ball. Because the cost of even relatively inexpensive balls which are so constructed is significant, impairment of the air retaining capacity of such a ball can result in a significant monetary loss to the owner thereof.

Such monetary loss becomes more significant in case wherein a ready supply of such balls is required as for example to satisfy the needs of a professional or semi-professional athletic team or the athletic department of an educational or other institution.

In the past, it has usually not been possible to repair a ball that does not contain an internal bladder. To repair a ball which uses a bladder, it is necessary to open the stitching in the covering of the ball, remove the damaged bladder and replace it with a new bladder. Some bladders are designed to permanently adhere to the ballcase upon inflation and may hamper or prevent repair because of the difficulty encountered in removal. The covering is then restitched and the new bladder inflated. The stitching operation requires learned skills and specialized equipment. Thus, the cost of such repair may rapidly approach or exceed the original purchase price of such a ball. The need exists, therefore, for a simple inexpensive means and method for repairing such balls when their air retention capabilities are impaired. Typically, such impairment results in a slow leakage of air from the ball and the ball will generally be found to be in need of inflation.

Caro in U.S. Pat. No. 2,012,376 issued Aug. 27, 1935 provided an inflatable ball which had a self-closing flap on its covering surface. When the flap was opened, a bladder could be inserted into or withdrawn from the covering. On the surface, diametrically opposite from the access flap, a small opening was provided to lend access to the air inflation valve of the bladder. The bladder was coupled in the vicinity of the valve to a metal plate which fit into a recess adjacent the inflation access opening. The flapped opening through which the bladder was to be inserted and withdrawn was reinforced to prevent the flap from protruding when the bladder was inflated. Inflation of the bladder automatically closed the flap and held it in its closed position.

As is known to those skilled in the art, the incorporation of metallic coupling devices for securing the bladder in position within the ball cover as well as the provision of reinforcing areas such as found within the access flap of Caro's ball leads to the formation of flat or dead spots or areas on the ball.

Those skilled in the art have sought to find less disadvantageous ways of replacing a damaged bladder within a ball and of maintaining that bladder within the desired position within the ball covering. A popular approach to solving these problems is to provide a ball covering with a relatively large access opening therethrough. The replaceable bladder is inserted through this relatively large opening. A special bladder construction is employed wherein a flange or washer having a larger diameter than the access opening in the ball cover is coupled to the bladder at the bladder inflation valve. The flange or washer is provided with a raised part or projection which is adapted to seat within the access opening in the ball cover when the bladder is inserted within the cover and inflated. Because the washer diameter exceeds that of the access opening within the ball cover, the opening is sealed thereby and the raised projection on the washer provides a substantially continuous ball covering surface by substantially filling in the void presented by the access opening in said cover.

Three typical examples of this latter approach are presented in U.S. Pat. No. 1,436,630, issued Nov. 21, 1922 to Buchner et al; in United Kingdom Pat. No. 528,832, issued Nov. 7, 1940 to Wilson; and in U.S. Pat. No. 4,274,633, issued June 23, 1981 to Benscher.

With these latter approaches, the bladder may be replaced by withdrawing it through the relatively large access opening provided within the ball covering at the time of manufacture. The flange or washer with the raised projection thereon is deformable so that it may be drawn through said access opening despite the fact that its diameter is larger than that of the access opening in the ball covering. Although these approaches seem practical and have proven popular with those skilled in the prior art, most inflatable balls comprised of a covering material with an inflatable bladder therein are manufactured with a relatively small opening within the cover of the ball. This small opening, generally on the order of ½ inch or less in diameter, permits communication with the inflation valve of the ball bladder. The bladder is inserted within the covering at the time of manufacture. The inflation valve is positioned within the small access opening in the ball cover and a relatively large reinforcing flange is cemented to the inside of the cover to maintain the bladder and inflation valve in position within the cover. The stitching of the cover is then completed and the ball bladder inflated. Such a bladder may or may not adhere to the ball cover permanently. When a ball so constructed is damaged and its air retention capabilities impaired, it is generally considered impractical to attempt to repair the ball. Various sealing fluids which may be deposited within the bladder serve merely to unbalance the ball and make its action erratic.

It is therefore an objective of the invention to provide means and method for readily, simply, and inexpensively repairing a damaged inflatable ball.

It is a particular objective of the invention to provide method and apparatus wherein a portion of the ball covering material may be removed without impairing any stitching in the ball cover and to permit a new bladder to be inserted and the repair of the surface integrity of the ball cover.

It is a more particular objective of the invention to provide method and apparatus wherein an inflatable ball, having once been repaired, may be even more readily repaired if its air retention capabilities are impaired a second or third or more times.

SUMMARY OF THE INVENTION

The method of repairing a damaged inflatable ball comprises the steps of cutting an access opening through the cover of the ball to be repaired while leaving any cover stitching intact. The valve is removed in the case of a ball with no inner bladder. The valve and any part or all of the inner bladder is removed from a ball with an inner bladder. A new inflatable bladder is inserted into the ball covering by means of said access opening. The new bladder is then affixed in position within the ball cover to provide for ease of inflation. With the new bladder so positioned, the surface integrity of the ball covering material is restored to eliminate the access opening while yet providing air valve access through the restored surface to the inflatable bladder so that said bladder may be inflated. To affix the bladder in position, an adhesive is employed about the peripheral region of the access opening. Adhesive which could occlude the air inflation valve of the bladder so as to preclude the inflation thereof, is removed.

To this end, a gluing tool is employed for the dual purpose of evenly distributing the adhesive and of positioning the inflation port of the valve within the access opening for later ease of inflation of the bladder. To restore the surface integrity of the ball cover, the void created between the bladder and the outer surface of the ball cover by the access opening is filled with an adhesive filler material. External access to the inflation port of the bladder is maintained while said adhesive material is introduced to the void created by the access opening. This is accomplished by inserting a shaft within the inflation port of the bladder valve and allowing this shaft to remain there until the adhesive filler material has stabilized sufficiently to permit the shaft to be removed therefrom without having the filler material flow so as to cover the void created by the removal of the shaft. The adhesive filler material may also be applied without inserting a shaft before application of the adhesive. In this case the inflation port of the bladder is restored by penetrating through the adhesive into the hole of the bladder valve with a cylindrical shaft, for example, a toothpick, needle, finishing nail, etc., after or while the adhesive material stabilizes.

This invention further consists of the manufacture comprising the repaired inflatable ball produced by the methods claimed herein.

In cooperation with a damaged inflatable ball having an exterior cover, apparatus is disclosed for repairing said damaged inflatable ball which comprises means for removing a portion of the covering of the damaged ball so as to provide an access opening to the interior thereof. Inflatable bladder means are provided for insertion within the covering of the damaged ball via the access opening provided by said means for removing a portion of the covering of the damaged ball. Further means maintainably position the inflatable bladder means within the covering of the damaged ball for ease of inflation of said bladder means. Also included are means for restoring the surface integrity of the covering of the damaged ball after said inflatable bladder means has been inserted within the covering of the damaged ball and maintainably positioned therein.

DETAILED DESCRIPTION OF THE INVENTION

Figure 1:
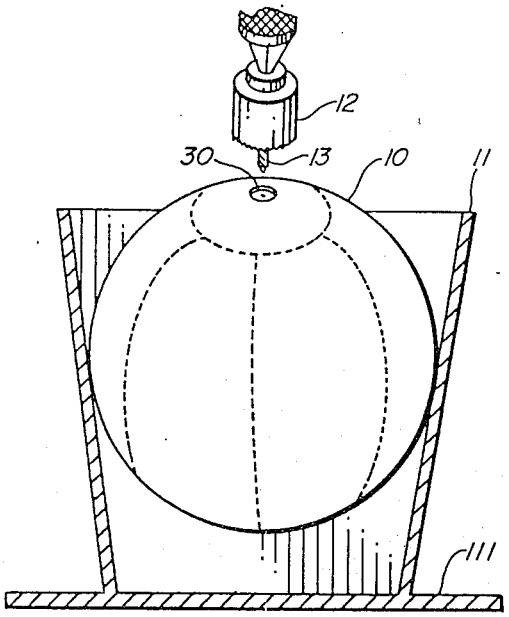
FIG. 1 illustrates an inflatable ball held by stable positioning means so that a portion of the ball covering may be removed to provide an access to the interior of the ball cover.

For purposes of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device; and such further applications of the principles of the invention as illustrated herein being contemplated as would normally occur to one skilled in the art to which the invention relates.

For purposes of exposition, a basketball is illustrated as representative of the type of damaged, inflatable balls which may be repaired utilizing the apparatus and method set forth herein. In FIG. 1, inflatable ball 10 is shown emplaced within a holder 11 which will maintain inflatable ball 10 in a stable position. Any holder adapted to this purpose may be utilized. A simple receptacle with inclined walls, such as a wastebasket, may be pressed into service for this purpose. The holder 11, illustrated, has extended base 111, on which to stand so that ball 10 and holder 11 may be held in a stable position.

Figure 2:
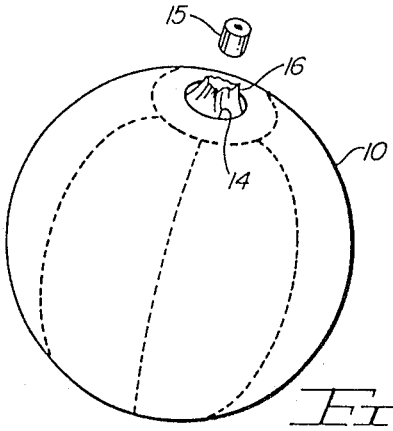
FIG. 2 illustrates a damaged valve and portion of the bladder being removed from the ball through the access opening provided by the means depicted in FIG. 1.

With the ball stabily positioned, a hole cutting saw comprised of annular cutting saw 12 and pilot drill 13 are positioned at the inflation port 30 of the damaged ball 10 and so operated as to remove a portion of the covering of ball 10 to provide an opening 14 (FIG. 2) through which inflation port 30 and any bladder material attached thereto may be removed, as well as providing access through which other debris may be removed.

Prior to this drilling operation, damaged ball 10 should be inflated to its approximate standard playing pressure, if at all possible. With inflatable ball 10 so inflated, the ball covering is physically inspected to detect the presence of thorns or other penetrating devices which have pierced the cover of ball 10 and could damage new bladder 16 (FIG. 3) when installed.

After removal of materials found to have penetrated the cover of the ball, ball 10 is placed under water to detect any leakage points. Any leakage points so detected are marked on the cover of the ball. Following this, the cutting operation depicted in FIG. 1 and described earlier is carried forth to provide an access opening 14 in the cover of ball 10 through which inflation port 30 and any bladder material attached thereto, as well as any other debris, may be removed.

Once the inflation port 30 has been removed from ball 10, the interior of the ball covering is cleaned to remove debris resulting from the cutting operation and any residue remaining from the use of foam or stop-leak solutions earlier employed in an attempt to prevent air leakage from ball 10. The areas defined by the periphery of hole 14 are inspected and trimmed with a sharp instrument to remove any portions of the old valve that might be remaining. The inner surface of the ball cover of ball 10 about the periphery of hole 14 is trimmed to be flat and smooth so as to provide a clear bearing surface for the new bladder to be inserted within the cover of ball 10 as part of the necessary repair operation.

Typically, the original manufacturer of ball 10 will have provided a rubber reinforcing washer about the original inflation port 30 of the original bladder 15. The cutting operation, depicted in and described with respect to FIG. 1, will leave much of this original reinforcing washer intact. It is not necessary to remove this washer, which now includes the opening of hole 14 but assurance should be made that its lower surface is clean and flat.

All debris of the trimming operations should be removed from the ball.

By placing a finger at any position marked on the surface of the cover of ball 10 where a leak was indicated and moving that finger so as to press the ball cover inward and upward toward access opening 14, the inner wall of the ball cover at the point of leakage may be inspected and any penetrating materials remaining within the wall of the ball cover may be removed as is to preclude their damaging the new bladder to be inflated as part of the repair procedure.

After all such leakage points have been so checked, inside of the ball cover may be inspected by viewing it through the opening 14 and by running a finger across the inner surface of the ball to detect any sharp projections which might present a potential danger to the integrity of the new bladder. An ordinary tire patch may be glued on the inside of the ball cover at a damaged point to prevent the ball cover from splitting at this point when the new bladder is installed and ball 10 is reinflated.

Figure 3:
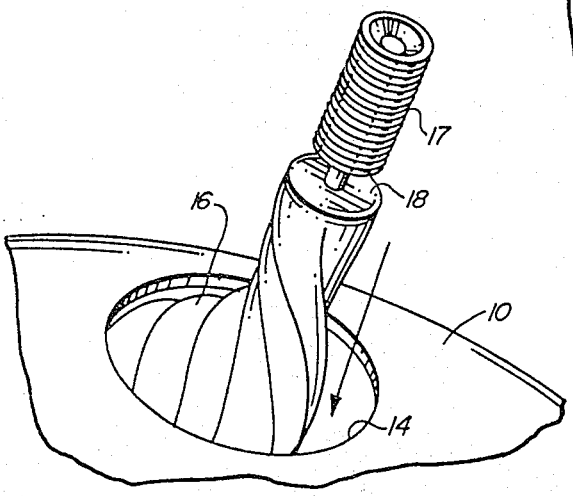
FIG. 3 illustrates the insertion of a new bladder into the ball covering through the access hole provided.
Figure 4:
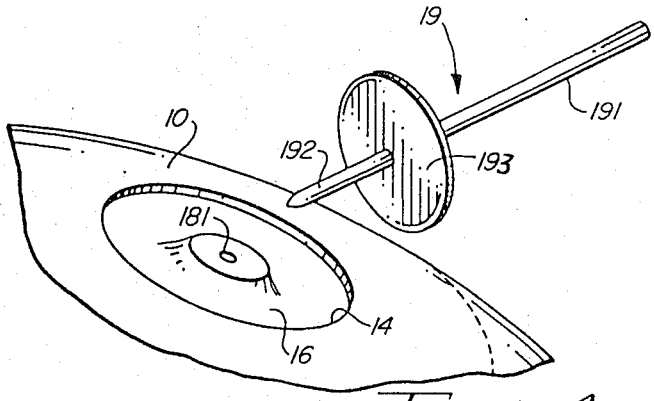
FIG. 4 illustrates the new bladder in place within the ball covering and a gluing tool about to be inserted into the valve of new bladder to adjust the bladder into position after the bladder has been fully inflated.

In FIG. 3, a new bladder 16 is shown being emplaced within access opening 14 in the cover of ball 10. Bladder 16 is commercially available and may, for the purpose of example, and not of limitation, be of the type sold by Supreme Rubber, Ltd., New Zealand, or Era Industries, Inc., Ohio. Bladder 16 has been rolled to facilitate its entry within opening 14. For purposes of illustration, opening 14 has been enlarged with respect to bladder 16 in the illustration of FIG. 3. In practice, opening 14 would be on the order of three-quarters of an inch diameter. The actual size is not critical and it is preferable to provide the smallest diameter opening 14 as will facilitate the removal of the damaged bladder 15 and the insertion of a new bladder 16 within the cover of ball 10.

A needle valve 17, generally employed for purposes of inflating bladder 16, has been shown inserted within the inflation port of bladder valve 18 in the illustration of FIG. 3. This arrangement facilitates the initial positioning of inflation valve 18 within access opening 14 in the cover of ball 10.

New bladder 16 is shaken to allow it to unroll and it is then inflated by use of needle valve 17 and a source of air, not shown, coupled thereto. Inflation of bladder 16 should be relatively slow and taken in stages to assure that bladder 16 completely unrolls and unfolds and the bladder fills ball 10 with bladder inflation valve 18 located generally central of access opening 14. Needle valve 17 can be manipulated while bladder 16 is being filled to position inflation valve 18 within the central region of access opening 14.

With bladder 16 inserted within the cover of ball 10 and bladder inflation valve 18 positioned for ease of inflation of bladder 16, it becomes desirable to affix bladder 16 in this position within the cover of ball 10. An adhesive inserted between the interior of the cover of ball 10 and the surface of bladder 16 will suffice to maintain bladder 16 in position. The danger exists, however, that, in introducing adhesive to this region, the inflation port 181 of bladder inflation valve 18 may become blocked by the inadvertent application of adhesive thereto and the ability to maintain bladder 16 in an inflated condition may be precluded.

One preferred method avoids the occlusion of the inflation port 181 of bladder inflation valve 18 by utilizing a gluing tool 19. Gluing tool 19 has a shaft 192 which may be inserted within inflation port 181 without causing bladder 16 to deflate. An extended handle 191 is provided to aid in manuvering gluing tool 19. Between the handle 191 and shaft 192 to be inserted in inflation port 181, a gluing shield 193 is disposed having a planar surface positioned transverse to the axis of shaft 192.

Figure 5:
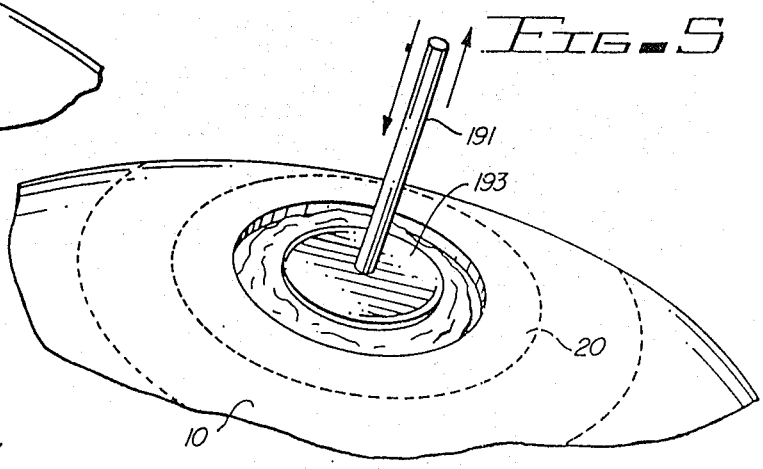
FIG. 5 illustrates the reciprocating movement of the gluing tool to facilitate the even distribution of the adhesive between the inner surface of the perimeter of the ball cover opening and the outer surface of the bladder, and the release of residue air between the outer surface of the bladder and the inner surface of the ball cover.
Figure 6:
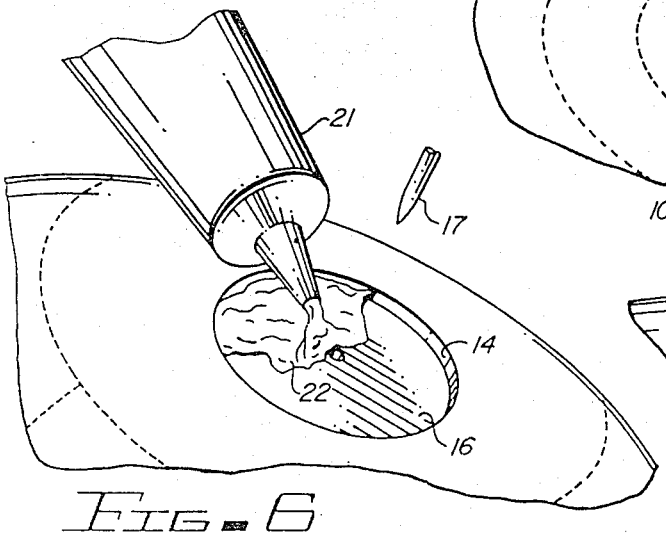
FIG. 6 illustrates the application of the silastic rubber adhesive so as to restore the surface integrity of the ball cover which results from the filling of void created by the access opening provided in said cover by means depicted in FIG. 1, and a cylindrical shaft about to penetrate through the adhesive into the inflation port of the bladder valve.

When shaft 192 of gluing tool 19 is inserted within inflation port 181 of inflation valve 18 of bladder 16, gluing shield 193 will be positioned atop the surface of inflation valve 18 and provide a protective covering therefore so as to prevent adhesive from inadvertently entering on or into the area of inflation port 181. FIG. 5 illustrates gluing tool 19 in position as described.

Handle 191 of gluing tool 19 may be manipulated so as to depress the surface of bladder 16 within the region of access opening 14 so as to permit adhesive 20 to be inserted into the region peripheral to access opening 14 and between the lower surface of the cover of ball 10 and the upper surface of bladder 16 in such regions. If necessary, handle 191 of gluing tool 19 may be manipulated so as to maintain the position of inflation valve 18 within the central region of access opening 14.

In inflating new bladder 16, care will have been taken not to excessively inflate the bladder so as to cause it to obtrude from access opening 14. Sufficient pressure should be provided to assure contact between the bladder and the inner surface of the cover of ball 10 so that good adhesion will be achieved when adhesive 20 is introduced about the periphery of access opening 14 and under the surface of the cover of ball 10 and to ensure that air is not trapped between the inside surface of both the cover of ball 10 and the outer surface of new bladder 16. This pressure is generally the pressure the ball would be filled to during normal use.

Once adhesive 20 has been applied, gluing tool 19 may be removed and the surface of the covering of ball 10 cleared of any adhesive which may have inadvertently spilled.

The ball is now set aside for the full period suggested by the manufacturer of the adhesive for purposes of allowing the adhesive to thoroughly set. A rubber adhesive is recommended and a typical setting period would be approximately twenty-four hours.

When adhesive 20 has properly set or cured, the surface integrity of the cover of ball 10 may be restored. This is accomplished by filling the void created between the upper surface of the cover of ball 10 and the surface of bladder 16 by access opening 14. In this preferred embodiment, the void created by access opening 14 in the cover of ball 10 will be filled with a silicon rubber adhesive filler material, However, before the filling is attempted, a shaft, such as provided as part of needle valve 17, is inserted into the inflation port of the inflation valve of bladder 16. Bladder 16 is then inflated to its normal working pressure. Needle valve 17 is then withdrawn to the point at which air will not exit from bladder 16 but the shaft of needle valve 17 will still be retained within the inflation port 181 of bladder inflation valve 18.

Adhesive filler material may now be introduced within the void created by access opening 14 in the cover of ball 10. The adhesive filler material 22, for example a silastic rubber, air-curing compound is readily available and commercially packaged within applicator tubes 21 which permit direct application of the filler material 22 as it exits from its container 21.

Filler material 22 is worked within the void created by opening 14 so as to thoroughly fill that void and to surround the shaft of needle valve 17. When adhesive filler material 22 has stabilized sufficiently, needle valve 17 is removed and an external opening providing access to inflation port 181 of bladder inflation valve 18 will remain and be preserved within the stablized adhesive filler material 22.

Figure 7:
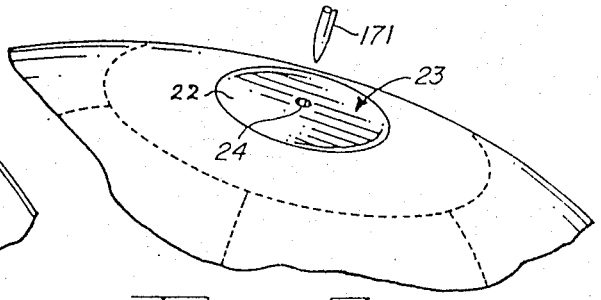
FIG. 7 illustrates the finished product with its surface integrity restored and valve opening for maintaining air pressure.

In an alternate preferred embodiment, the occlusion of the inflation port 181 of bladder inflation valve 18 is not avoided, rather, filler material 22 is worked within the void created by opening 14 so as to thoroughly fill that void, covering bladder inflation valve 18 and inflation port 181. When adhesive filler material 22 has been sufficiently shaped to the proper ball curvature, a cylindrical shaft 171 (FIG. 7, for example, a needle, pin, toothpick, or finishing nail) is inserted through the adhesive into inflation valve 18. Shaft 171 is left in place but rotated intermittently until adhesive filler material 22 has stabilized sufficiently. This is to ensure that shaft 171 may be removed once adhesive filler material 22 stabilizes, leaving an external opening 24 into inflation port 181. Care is taken not to insert shaft 171 deeply so as to release air pressure.

At this time, any material which has been spilled onto the cover of ball 10 should be removed and the adhesive filler material 22 be permitted to fully cure.

When filler material 22 has fully cured, it may be abrasively shaped to conform to the contour of the inflated cover of ball 10. When this is accomplished, the ball will bounce true and not display a dead spot. In addition, exterior access 24 will be provided to inflation port 181 of bladder inflation valve 18.

The end product produced by the practice of the method of this invention is a repaired inflatable ball. In addition, that end product itself may be readily repaired should it suffer further damage. The plug 23 created by the cured adhesive filler material 22 may be readily removed by employing a sharp instrument to cut it away from the periphery of opening 14 originally created in the cover of ball 10. The adhesive bond created by adhesive 20 between bladder 16 and the inner surface of the cover of ball 10 may be readily broken by applying pressure to the bladder 16 with a blunt instrument. At this point, the interior of the ball may be cleaned, inspected and any sharp projections removed and the process of inserting a new bladder, adhesively affixing it within the ball cover and restoring the surface integrity of that ball covering may be undertaken.

The apparatus disclosed herein for the practice of the invention is seen to comprise means 12 and 13 for removing a portion of the covering of damaged ball 10 so as to provide an access opening 14 to the interior of the ball; inflatable bladder means 16, which is to be inserted within the ball cover via access opening 14; means 20 for maintainably positioning inflatable bladder 16 within the cover of ball 10 so as to permit easy inflating of bladder 16; and means 22 for restoring the surface integrity of the covering of ball 10 after inflatable bladder means 16 has been inserted within the covering of ball 10 and maintainably positioned therein by means 20.

What has been disclosed herein are means and method for repairing an inflatable ball damaged to the extent that its ability to remain inflated has been impaired. The method comprises the steps of removing a portion of the ball covering so as to permit the removal of the damaged valve or valve and bladder and the insertion of a replacement bladder; maintainably positioning the replacement bladder within the ball covering for ease of inflation thereof; and the restoring of the surface integrity of the ball cover while providing external access through the restored surface to the inflation valve of the replacement bladder. Apparatus has been disclosed for carrying forth the steps of the method and the end result of practicing the method is seen to be a manufacture comprising a repaired inflatable ball.

Those skilled in the art will readily conceive of modifications to the method and apparatus drawn from the teachings presented herein. To the extent that such modifications are so drawn, it is intended that they shall fall within the ambit of protection provided by the claims appended hereto.

Having described by invention in the foregoing specification and the accompanying drawings in such clear and concise manner that those skilled in the art may readily understand and practice the invention, that which I claim is:

1. A method of repairing an inflatable ball comprising the steps of:

cutting an access opening about the existing inflation port and through the cover of a ball to be repaired, leaving any cover stitching intact;

removing any existing bladder from said ball cover via said access opening;

inserting an inflatable bladder into said ball cover via said access opening;

adhesively affixing said inflatable bladder within said ball cover in position for ease of inflation thereof; and selectively applying an adhesive filler material to said access opening for purposes of restoring the surface integrity of said ball cover by eliminating said access opening while providing air valve access through said restored surface to said inflatable bladder for inflation thereof.

2. The method of claim 1 wherein the step of affixing said inflatable bladder within said ball cover comprises the further step of adhesively affixing said bladder to the peripheral region of said access opening.

3. The method of claim 2 wherein the step of adhesively affixing said bladder to the peripheral region of said access opening comprises the further step of protecting the inflation port of said bladder to prevent adhesive from precluding inflation of said bladder.

4. The method of claim 3 wherein the step of protecting the inflation port of said bladder comprises the further step of covering said inflation port with a gluing tool to preclude adhesive from entering said inflation port and to maintain said inflation port in position within said access opening for ease of inflation of said bladder.

5. The method of claim 1 wherein the step of restoring the surface integrity of said ball cover comprises the step of filling the void between said bladder and the outer surface of said ball cover created by said access opening with said adhesive filler material.

6. The method of claim 5 wherein the step of filling the void between said bladder and the outer surface of said ball cover comprises the further step of maintaining external access to the inflation port of said bladder.

7. The method of claim 6 wherein the step of maintaining external access to the inflation port of said bladder comprises; the further steps of inserting a removable shaft into said inflation port of said bladder;

allowing said adhesive filler material to encompass said removable shaft as the void between said bladder and the outer surface of said ball cover is filled; and removing said shaft when said adhesive filler material has stabilized sufficiently to maintain the external access to the inflation port of said bladder created by the removal of said shaft.

8. The method of claim 4 or 7 wherein the step of providing an access opening in the cover of a ball to be repaired further comprises the step of:

clearing the interior of said ball cover of debris and material which might threaten the future integrity of the inflatable bladder to be inserted within said ball cover.

9. The method of claim 2 wherein the step of adhesively affixing said bladder to the peripheral region of said access opening comprises the further step of filling the void between said bladder and the outer surface of said ball cover created by said access opening with an adhesive filler material covering the inflation port of said bladder.

10. The method of claim 9 wherein the step of restoring the access to said inflation port of said bladder comprises inserting a cylindrical shaft through said adhesive material and into said inflation port of said bladder.

11. The method of claim 10 wherein the step of restoring access to said inflation port of said bladder comprises:

the further steps of allowing said adhesive filler material to stabilize;

inserting a removable shaft through said adhesive filler material and into said inflation port of said bladder; and removing said shaft after penetration into said inflation port of said bladder.

12. The method of claim 11 wherein the step of providing an access opening in the cover of a ball to be repaired further comprises the step of:

clearing the interior of said ball cover of debris and material which might threaten the future integrity of the inflatable bladder to be inserted.

13. A method of repairing an inflatable ball comprising the steps of:

providing an access opening about the existing inflation port in the cover of a ball to be repaired, leaving any cover stitching intact;

removing any existing bladder from said ball cover via said access opening;

clearing the interior of said ball cover of debris and material which might impair the future integrity of an inflatable bladder inserted within said ball cover;

inserting an inflatable bladder within said ball cover via said access opening;

positioning said inflatable bladder within said ball cover for ease of inflation thereof;

inflating said inflatable bladder;

adhesively affixing said bladder to the region peripheral to said access opening;

restoring the surface integrity of said ball cover by filling the void between said bladder and the outer surface of said ball cover created by said access opening with an adhesive filler material;

allowing adhesive filler material to stabilize;

restoring access to inflation port of said bladder by inserting a cylindrical shaft through said adhesive material and into said inflation port of said bladder; and removing said cylindrical shaft from said inflation port of said bladder.

14. A method of repairing an inflatable ball comprising the steps of:

providing an access opening about the existing inflation port in the cover of a ball to be repaired, leaving any cover stitching intact;

removing any existing bladder from said ball cover via said access opening;

clearing the interior of said ball cover of debris and material which might impair the future integrity of an inflatable bladder inserted within said ball cover;

inserting an inflatable bladder within said ball cover via said access opening;

adhesively affixing said bladder to the region peripheral to said access opening;

positioning said inflatable bladder within said ball cover for ease of inflation thereof;

protecting the inflation port of said bladder to prevent adhesive from precluding inflation of said bladder;

restoring the surface integrity of said ball cover by filling the void between said bladder and the outer surface of said ball cover created by said access opening with an adhesive filler material; and maintaining air valve access through said adhesive filler material to said inflatable bladder for inflation thereof.

15. The method of claim 14 wherein the step of protecting the inflation port of said bladder comprises the further step of covering said inflation port with a gluing tool to preclude adhesive from entering said inflation port and to maintain said inflation port in position within said access opening for ease of inflation of said bladder.

16. The method of claim 14 wherein the step of maintaining air valve access through said adhesive filler material to said inflatable bladder comprises the further steps of inserting a removable shaft into said inflation port of said bladder;

allowing said adhesive filler material to encompass said removable shaft as the void between said bladder and the outer surface of said ball cover is filled; and removing said shaft when said adhesive filler material has stabilized sufficiently to maintain the external access to the inflation port of said bladder created by the removal of said shaft.

17. A manufacture comprising a repaired inflatable ball produced by the method of claim 1.

18. A manufacture comprising a repaired inflatable ball produced by the method of claim 4.

19. A manufacture comprising a repaired inflatable ball produced by the method of claim 7.

20. A manufacture comprising a repaired inflatable ball produced by the method of claim 11.

21. A manufacture comprising a repaired inflatable ball produced by the method of claim 13.

22. A manufacture comprising a repaired inflatable ball produced by the method of claim 14.

23. A manufacture comprising a repaired inflatable ball produced by the method of claim 15.

24. A manufacture comprising a repaired inflatable ball produced by the method of claim 16.

25. In combination with a damaged inflatable ball having an exterior cover, apparatus for repairing said inflatable ball comprising:

means for removing a portion of the covering of a damaged ball to be repaired to provide an access opening to the interior of such a ball;

inflatable bladder means inserted within the covering of the damaged ball via said access opening provided by said means for removing a portion of the covering of the ball;

adhesive means for maintainably positioning said inflatable bladder means within the covering of the damaged ball of ease of inflating said bladder means; and adhesive filler material for restoring the surface integrity of the covering of the damaged ball after said inflatable bladder means has been inserted within the covering of the damaged ball and maintainably positioned therein.

* * * * *